US006356014B2

(12) United States Patent
Xu et al.

(10) Patent No.: US 6,356,014 B2
(45) **Date of Patent: *Mar. 12, 2002**

(54) ELECTRON EMITTERS COATED WITH CARBON CONTAINING LAYER

(75) Inventors: Xueping Xu, Stamford; George R. Brandes, Danbury, both of CT (US); Christopher J. Spindt, Menlo Park, CA (US); Colin D. Stanners, San Jose, CA (US); John M. Macaulay, Mountain View, CA (US)

(73) Assignees: Candescent Technologies Corporation, San Jose, CA (US); Advanced Technology Materials, Inc., Danbury, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/826,454

(22) Filed: Mar. 27, 1997

(51) Int. Cl.[7] ..... H01J 1/30; H01J 19/24

(52) U.S. Cl. ..... 313/497; 313/309; 313/336

(58) Field of Search ..... 313/309, 351, 313/336, 495, 496, 497; 315/169.1; 445/24, 50, 51, 60

(56) References Cited

U.S. PATENT DOCUMENTS

| | | | | |
|---|---|---|---|---|
| 4,193,013 | A | 3/1980 | Futamoto et al. | 313/341 |
| 4,994,221 | A | 2/1991 | Tanaka et al. | 264/81 |
| 5,089,292 | A | 2/1992 | MaCaulay et al. | 427/78 |
| 5,129,850 | A | 7/1992 | Kane et al. | 445/24 |
| 5,141,460 | A | 8/1992 | Jaskie et al. | 445/24 |
| 5,190,796 | A | 3/1993 | Iacovangelo | 427/304 |

(List continued on next page.)

FOREIGN PATENT DOCUMENTS

| | | | |
|---|---|---|---|
| EP | 0 528 391 A1 | 8/1992 | H01J/9/02 |
| EP | 0 528 391 B1 | 8/1992 | H01J/9/02 |
| GB | 2204991 | 11/1988 | H01J/1/30 |
| GB | 2 260 641 | 4/1993 | H01J/1/30 |
| GB | 2267176 | 11/1993 | H01J/9/02 |
| WO | WO 95/26037 | 9/1995 | H01J/1/02 |
| WO | WO 96/08028 | 3/1996 | H01J/9/02 |
| WO | WO 98/13849 | 4/1998 | H01J/1/16 |

OTHER PUBLICATIONS

Amaratunga et al., "Nitrogen containing hydrogenated amorphous carbon for thin–film field emission cathodes", *Appl. Phys. Lett,*. 68 (18), Apr. 29, 1996, pp. 2529–25311.

Chuang et al., "Enhancement of electron emission efficiency of mo tips by diamondlike carbon coatings", *Appl. Phys. Lett.*, 68 (12), Mar. 18, 1996, pp. 1666–1668.

Dadykin, et al., "A study of stable low–field electron emission from diamond–like films", *Diamond and Related Materials*, 5, 1996, pp. 771–774 (no month).

Djubua et al., "Emission Properties of Spindt–Type Cold Cathodes with Different Emission Cone Material", *IEEE Transactions of Electron Devices*, vol. 36, No. 10, Oct. 1991, pp. 2314–2316.

(List continued on next page.)

*Primary Examiner*—Michael H. Day
(74) *Attorney, Agent, or Firm*—Skjerven Morrill MacPherson LLP; Ronald J. Meetin

(57) ABSTRACT

A cathode structure suitable for a flat-panel display contains an emitter layer (213) divided into emitter lines, a plurality of electron emitters (229, 239, or 230) situated over the emitter lines, and a gate layer (215A) having an upper surface spaced largely above the electron emitters. The gate layer has a plurality of gate holes (215B) each corresponding to one of the electron emitters. The cathode structure further includes a carbon-containing layer (340, 240, or 241) coated over the electron emitters and directly on at least part of the upper surface of the gate layer such that at least part of the carbon-containing layer extending along and above the gate layer is exposed.

68 Claims, 9 Drawing Sheets

U.S. PATENT DOCUMENTS

| | | | | | |
|---|---|---|---|---|---|
| 5,199,918 | A | | 4/1993 | Kumar | 445/50 |
| 5,202,571 | A | | 4/1993 | Hirabayashi et al. | 257/10 |
| 5,278,475 | A | | 1/1994 | Jaskie et al. | 315/169.3 |
| 5,341,063 | A | * | 8/1994 | Kumar | 313/309 |
| 5,462,467 | A | * | 10/1995 | Macaulay et al. | 445/50 |
| 5,463,271 | A | | 10/1995 | Geis et al. | 313/346 |
| 5,469,014 | A | | 11/1995 | Itoh et al. | 313/308 |
| 5,534,743 | A | | 7/1996 | Jones et al. | 313/309 |
| 5,541,423 | A | | 7/1996 | Hirabayashi | 257/77 |
| 5,556,530 | A | | 9/1996 | Finkelstein et al. | 205/122 |
| 5,559,389 | A | | 9/1996 | Spindt et al. | 313/310 |
| 5,564,959 | A | | 10/1996 | Spindt et al. | 445/24 |
| 5,583,393 | A | | 12/1996 | Jones | 313/495 |
| 5,608,283 | A | * | 3/1997 | Twichell et al. | 313/309 |
| 5,697,827 | A | * | 12/1997 | Rabinowitz | 445/60 |
| 5,869,169 | A | | 2/1999 | Jones | 428/213 |

OTHER PUBLICATIONS

Evtukh et al., "Parameters of the tip arrays covered by low work function layers" *J. Vac. Sci. Technology B*, 14(3), May/Jun. 1996, pp. 2130–2134.

Jung et al., "Emission Characteristics of DLC Coated Mo Tips FEA", Euro Display, 1996, pp. 203–206 (no month).

Liu, et al., "Modification of Si field emitter surfaces by chemical conversion to SiC", *Journal of Vacuum Science & Technology* B 12, No. 2, Mar./Apr. 1994, pp. 717–721.

Mousa et al., "The effect of hydrogen and acetylene processing on microfabricated field emiter arrays", *Applied Surface Science*, 67, 1993, pp. 218–221.

Mousa, "Investigations of in situ carbon coating on field–emitter arrays", *Vacuum*, vol. 45, No.2/3, 1994, pp. 241–244, 1994 (no month).

Myers et al., "Characterization of amorphous carbon coated silicon field emitters" *J. Vac. Sci. Technology*, B14(3), May/Jun. 1996, pp. 2024–2029.

Bastl, "Work Function Studies of Propylene, Acetylene, Hydrogen and Nitrogen Chemisorption on Molybdenum," *Collection Czechoslovak Chem. Commun.*, vol. 47, No. 11, Nov. 1982, pp. 2996–3003.

Bozler et al., "Arrays of Gated Field–Emitter Cones Having 0.32–$\mu$m Tip–to–Tip Spacings," IVMC 1993 Tech. Dig., 6th Int'l Vac. Microelecticron Conf., Jul. 12–15, 1993, pp. 8–9.

Bozler et al, "Arrays of gated field–emitter cones having 0.32 $\mu$M tip–to–tip spacing," *J. Vac. Sci. Technol. B*, vol. 12, No. 2, Mar./Apr. 1994, pp. 629–632.

van Veen , "Collimated Sputter Deposition, a novel method for large deposition of Spindt type field emission tips, "Revue"Le Vide, les Couches Minces", Supplement to No. 271 Mar.–Apr. 1994, pp. 33–36.

* cited by examiner

ELECTRON EMITTERS COATED WITH CARBON CONTAINING LAYER

GOVERNMENT RIGHTS IN INVENTION

This invention was made with Government support under Contract No. N00014-96-C-0266 awarded by the Office of Naval Research. The Government has certain rights in this invention.

BACKGROUND OF THE INVENTION

1. Field of the Invention

This invention relates to electron emission devices. More specifically, this invention relates to the structure and manufacture of electron emissive elements used in flat panel displays.

2. Background Art

In a flat panel display, a matrix of electron emitters emit electrons that impinge on a transparent display panel coated with light emitting material such as phosphor. The principles of a flat panel display can be more clearly explained by referring to FIGS. 1A, 1B, and 1C (collectively FIG. 1), which illustrate a flat panel display structure.

In FIG. 1A, backplate 120 is provided as a support to which electrically conductive emitter layer 113 is attached. Generally conical electron emitters 116 are formed on emitter layer 113. In FIG. 1B, electron emitters 116 are formed within gate holes 115B, under gate layer 115A. Gate layer 115A is separated from emitter layer 113 by dielectric layer 117. Display panel 118 having light emissive layer 110 and anode layer 111 is situated above, and spaced vertically apart from, gate layer 115A.

Portions of gate layer 115A are provided with sufficiently greater voltage than emitter layer 113 and electron emitters 116 to enable layer 115A to extract electrons from electron emitters 116. Anode layer 111 is at a considerably greater voltage than emitter layer 113 or gate layer 116. As a result, a large fraction of the-electrons emitted from electron emitters 116 are attracted by anode layer 111 toward transparent panel 118. With anode layer 111 being quite thin, the electrons pass through anode layer 111 and impinge on the phosphor coating 110 on panel 118, causing light emissive layer 110 to emit light.

FIG. 1C shows a cathode structure 100 for a flat panel display. Emitter layer 113 is divided into mutually insulated emitter rows 114, while gate layer 115A is divided into mutually insulated columns 184. For a black and white display, the overlapping area of a row 114 and a column 184 (see FIG. 1D) represents a pixel, the smallest element of a picture. For a color display, several (normally three) overlapping row/column areas form a pixel. In order to cause a selected group of emitters 116 to emit electrons thereby to energize a pixel, an appropriate electric field must be created between electron emitters 116 and gate layer 115A. In particular, a voltage must be applied between a selected row 114 and a selected column 184 to place that row 114 at a suitably greater potential than that column 184, thereby causing electron emission from emitters 116 at that row/column intersection. When the voltage between the selected row 114 and the selected column 184 is below a non-zero threshold value, emitters 116 at the row/column intersection do not emit electrons, and the corresponding pixel is not excited.

Referring to FIG. 1C, a complete picture requires the scanning of every row and every column. In order to have the picture appear to be continuous to the human eye, the scanning must be performed at high speed. Thus the voltage between a specific row and column must change in a very short time.

The geometry of rows 114 and columns 184 together with the thickness H and dielectric constant of dielectric layer 117 determines the crossover capacitance between a row 114 and a column 184. When thickness H is small, the crossover capacitance is large. This capacitance substantially slows down the activation of electron emitters 116, resulting in poor display. Therefore, it is desirable that dielectric layer 117 be thick. When the thickness of dielectric layer 117 increases, the height of electron emitters 116 normally must also increase in order to bring their tips sufficiently close to gate layer 115A to enable layer 115A to extract electrons from them.

A thick dielectric layer also reduces the possibility of short circuiting. During display operation, undesirable conductive paths may be produced through dielectric layer 117 so as to short circuit emitter layer 113 and gate layer 115A. As thickness H (FIG. 1D) of dielectric layer 117 increases, the likelihood of short circuiting gate layer 115A to emitter layer 113 by creating such a conductive path decreases. Further, in FIG. 1A, hollow spaces 119 keep gate layer 115A spaced apart from electron emitters 116. Because gate holes 115B are typically quite small, as little as 80 nm in diameter, a metal particle falling into hollow space 119 may cause short circuiting between gate layer 115A and electron emitters 116. With a thick dielectric layer 117, hollow space 119 would have an elongated profile. A particle falling into hollow space 119 tends to rest within the hollow space and away from gate hole 115B, and thus is less likely to cause short circuiting.

For conical electron emitters with a given aspect ratio (height to base diameter), larger gate holes 115B are required in order to create higher conical electron emitters 116. However, for fine quality picture, it is desirable to have more electron emitters per unit area. Thus it is desirable to have small gate holes. Small gate holes also give greater field strength at the emitters, resulting in lower applied voltage between rows and columns to achieve a given emission current. High aspect ratio cones allow a thick dielectric layer to be used, thus giving the advantages of reduced cross-over capacitance and greater short protection. Consequently, a higher aspect ratio is desirable for making a better cathode structure.

Certain materials such as nickel can be used to create electron emitters with a high aspect ratio. However, nickel does not have other properties desired for electron emitters. For example, nickel has poor chemical robustness. Also, nickel is easily oxidized. Oxidized nickel emitters have an increased extraction voltage and decreased emission stability.

Nickel has a relatively high work function. Work function is defined as the level of energy necessary to energize an electron to such a level that the electron is emitted from the material. A high work function means that a stronger electric field is required between the electron emitter 116 and corresponding column 184 of gate layer 115A in order to energize the electrons. This stronger electric field translates to a greater column-to-row extraction voltage. A high column-to-row extraction voltage is undesirable because it results in high power consumption and more expensive circuitry.

It is therefore desirable to have electron emitters with a high aspect ratio, good chemical robustness and low work function.

GENERAL DISCLOSURE OF THE INVENTION

In accordance with the present invention, improved electron emitters are provided with high aspect ratios, good chemical robustness and low work function.

Electron emitters are formed with electrically non-insulating material that allows deposition to a high aspect ratio at low deposition temperature. One candidate material for the electron emitters is nickel.

Electron emitters so made are coated with surface material that has good chemical robustness and low work function. One candidate for the surface material is carbon. The emitter and surface materials may also be chosen for other desirable electrical or chemical properties. Work function of coated emitters is typically reduced by about 0.8 to 1.0 eV.

DESCRIPTION OF THE PREFERRED EMBODIMENTS

Herein, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m.

Examples of electrically conductive materials (or electrical conductors) are metals, metal-semiconductor compounds (such as metal suicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are metal-insulator composites, graphite, amorphous carbon, and modified (e.g., lightly doped or laser-modified) diamond.

Figure 1A:
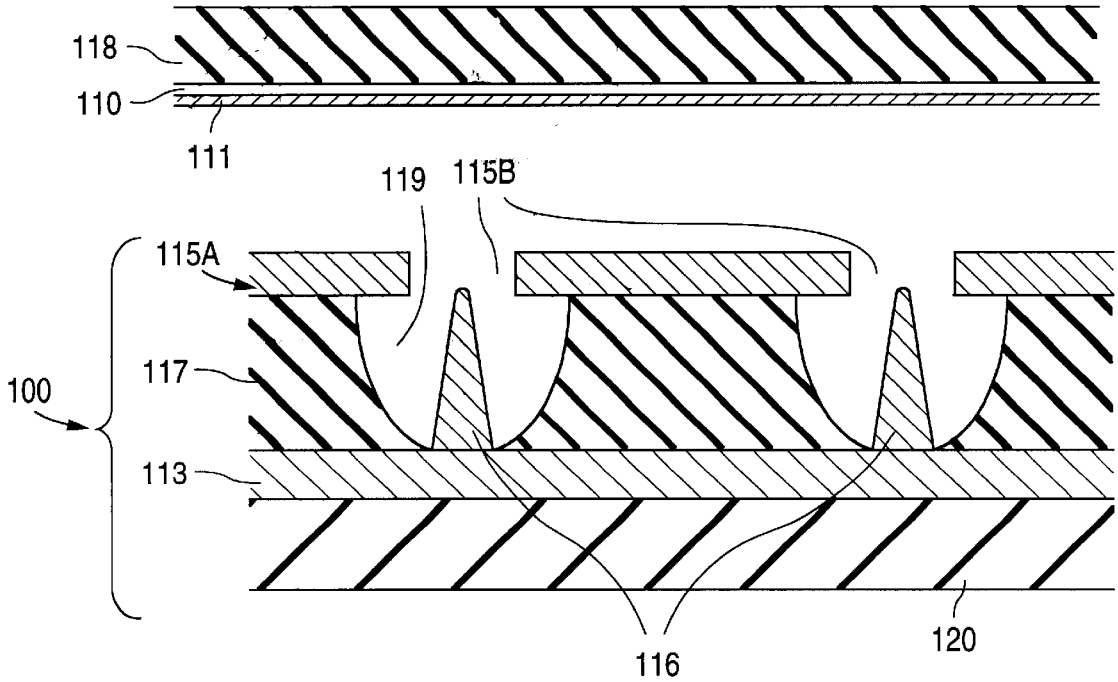
Fig. 1A Prior Art
FIG. 1A is a perspective view of a conventional flat panel display.
Figure 1B:
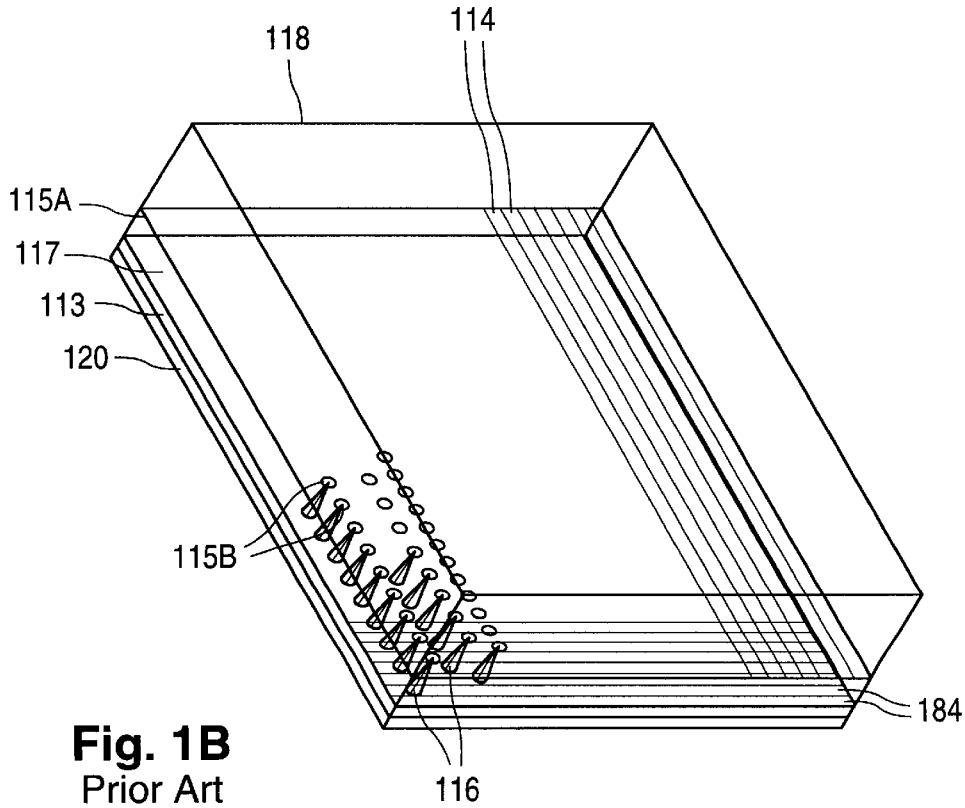
Fig. 1B Prior Art
FIG. 1B is a cross-sectional view of a portion of the conventional flat panel display of FIG. 1A.
Figure 1C:
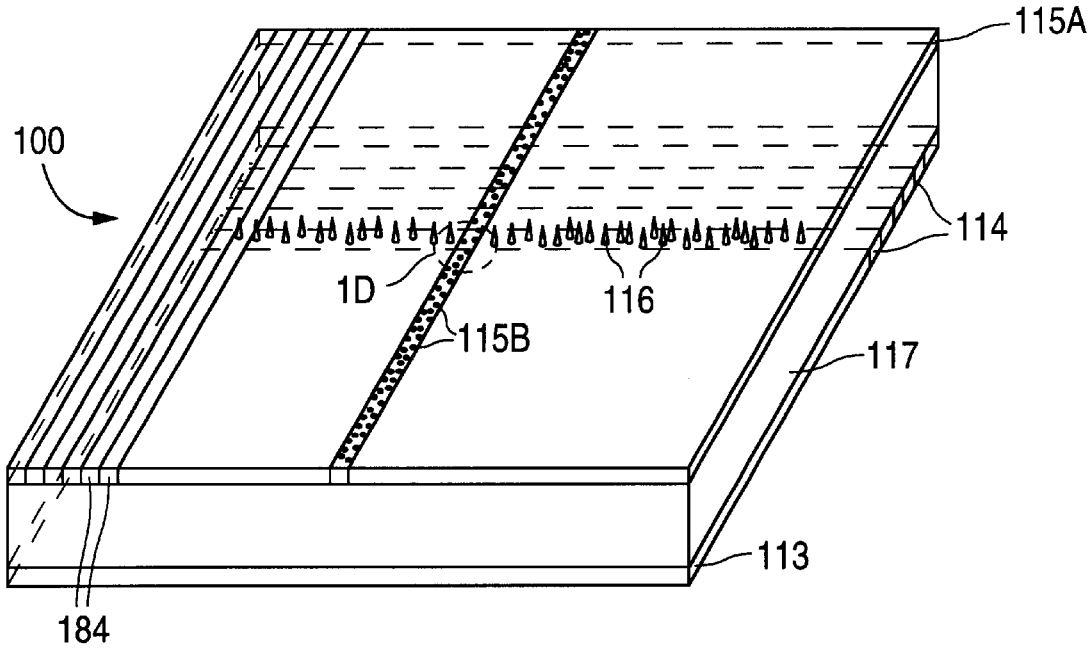
Fig. 1C Prior Art
FIG. 1C is a perspective view of a cathode structure in the conventional flat panel display of FIG. 1A.
Figure 1D:
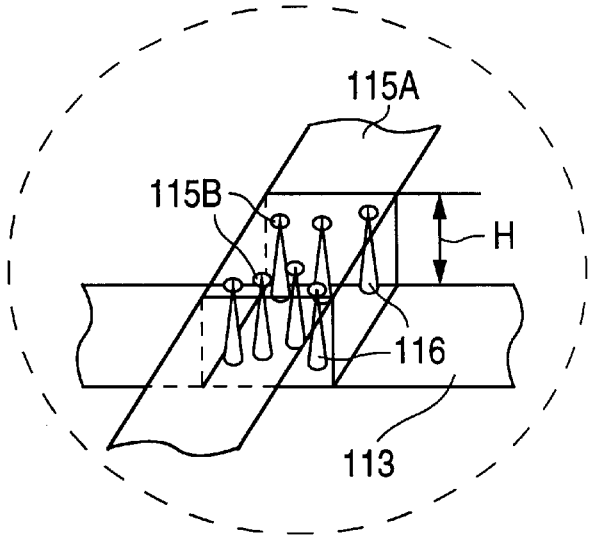
Fig. 1D Prior Art
FIG. 1D is a magnified view of part of the cathode structure of FIG. 1C.
Figure 2A:
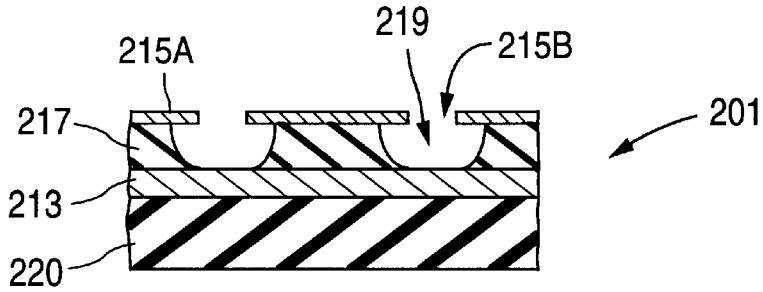
FIGS. 2A–2F are cross-sectional views representing steps in accordance with this invention for fabricating a cathode structure with electron emitters.

FIGS. 2A, 2B, 2C, 2D, and 2E (collective FIG. 2) show one process for manufacturing a flat panel display according to the invention's teachings. Electrically non-insulating emitter layer 213 patterned into emitter rows is provided on electrically insulating backplate 220. Emitter (or cathode) layer 213 is typically formed with metal, such as aluminum or nickel, covered by electrically resistive material, such as lightly doped polycrystalline silicon, a silicon carbon nitrogen compound, or cement (ceramic with embedded metal particles). In FIG. 2A, dielectric layer 217, typically silicon oxide, is deposited on emitter layer 213. On top of dielectric layer 217 is deposited electrically non-insulating gate material, typically a metal, to form gate layer 215A, thereby providing sub-structure 201.

Gate holes 215B are selectively etched through gate layer 215A. U.S. patent application Ser. No. 08/660,535, filed June 7, 1996, now U.S. Pat. No. 5,755,944 discloses a method for etching gate holes using electrophoretic or dielectrophoretic particle deposition. U.S. Pat. Nos. 5,462,467 and 5,564,959 disclose methods for making gate holes using charged-particle tracks. The contents of these three documents are incorporated by reference herein.

After gate holes 215B are formed, structure 201 is cleaned. Structure 201 is then subjected to another etchant to remove exposed parts of dielectric material 217 and form hollow spaces 219.

Figure 2B:
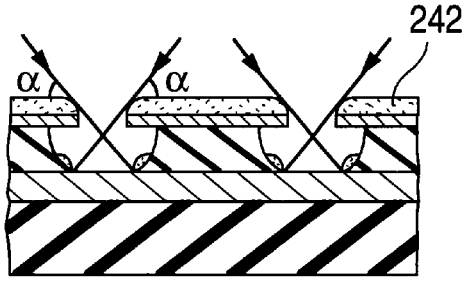

In FIG. 2B, liftoff layer 242 is then deposited on gate layer 215A. The material for liftoff layer 242 is chosen so that it can be selectively etched away with respect to gate layer 215A, dielectric layer 217 and lower electrically non-insulating emitter region 213. Liftoff layer 242 is deposited on the top of gate layer 215A at an angle a relative to the upper surface of gate layer 215A. Angle a is so chosen that the liftoff material will not be deposited on the exposed areas of emitter layer 213 within hollow spaces 219. Angle a depends on the geometry of hollow spaces 219. For a thicker dielectric layer 217, angle $\alpha$ can be larger, and vice versa. Angle a is also dependent on the geometry of gate holes 215B. For a larger gate hole 215B, angle $\alpha$ can be smaller, and vice versa.

Figure 2C:
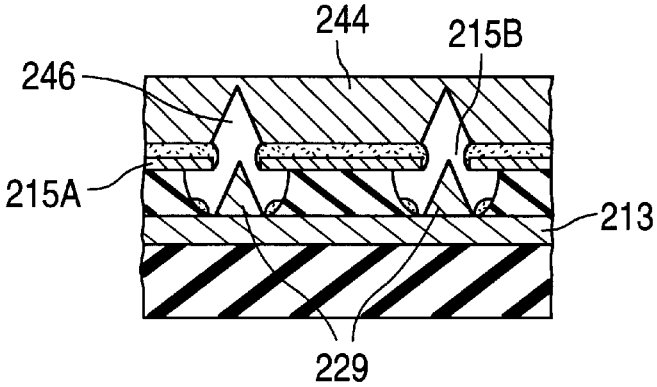

In FIG. 2C, electrically non-insulating emitter material is deposited, typically by physical vapor deposition, on top of the structure in a direction generally perpendicular to the upper surface of gate layer 215A. This emitter material accumulates on liftoff layer 242 and passes through gate holes 215B to accumulate on lower electrically non-insulating emitter layer 213. Openings 246 through which emitter material enters hollow spaces 219 progressively close as the emitter material accumulates on electrically non-insulating emitter layer 213. The deposition is performed until openings 246 are fully closed. As a result the emitter material accumulates in hollow spaces 219 to form generally conical electron emitters 229. A continuous layer 244 of the emitter material is simultaneously formed on liftoff layer 242.

Figure 2D:
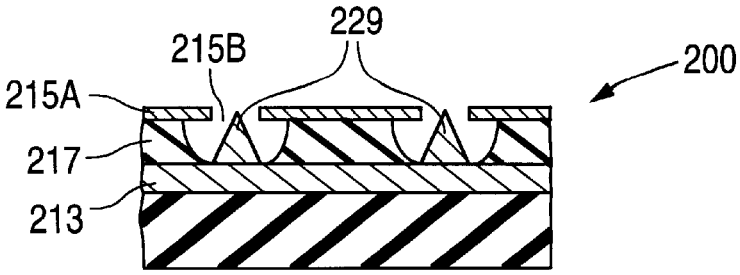

Liftoff layer 242 is then removed with a suitable etchant. During the removal of liftoff layer 242, excess emitter material layer 244 is lifted off. FIG. 2D shows the resultant cathode structure 200 with electron emitters 229. Each electron emitter 229 is concentric with a corresponding gate hole 215B.

In an alternative embodiment, the step of depositing liftoff layer 242 is eliminated. Electrically non-insulating emitter material is deposited on top of structure 201 directly to form electron emitters. U. S. patent application Ser. No. 08/610,729, filed May 5, 1996, now U.S. Pat. No. 5,766,446 discloses the technology and is herein incorporated by reference.

The emitter material is normally a metal such as nickel. Openings 246 close at different speeds depending on the chemical composition of the emitter material used. When openings 246 close faster, electron emitters 229 have a lower aspect ratio. As used here, "aspect ratio" means the height of an emitter divided by its maximum diameter. The maximum diameter of a conical emitter occurs at its base. Accordingly, the aspect ratio of each conical emitter 229 is its height divided by its base diameter. For emitters 229 with a fixed base diameter, a lower aspect ratio means that they have a lesser height, while a higher aspect ratio means that they have a greater height.

The speed at which openings 246 close determines the aspect ratio of emitters 229. When openings 246 close faster, emitters 229 have a low aspect ratio, and vice versa.

In one embodiment where physical vapor deposition is employed to deposit emitters 229, increasing the deposition temperature causes openings 246 to close slower, resulting in a higher aspect ratio for emitters 229. At high temperature, however, physical vapor deposition techniques become more complicated. Therefore, a low temperature physical vapor deposition process is typically employed for making emitters 229.

Certain metals, such as nickel, have a unique property that allows them to deposit through suitable deposition openings at a high aspect ratio at low temperature. At 25° C. (approximately room temperature), the aspect ratio of nickel emitters is between 1.5 and 2.0. With certain other metals, the aspect ratio is considerably lower. Molybdenum emitters, for example, can be deposited to an aspect ratio of 0.9–1.0 at 25° C.. To obtain an aspect ratio of about 1.0 with metal other than nickel or molybdenum, a temperature of 400° C. to 600° C. is often required. Generally, materials that can be deposited to an aspect ratio of at least 1.2 using physical vapor deposition at room temperature (25° C.) are highly desirable.

Other techniques such as electroplating as disclosed in U.S. Pat. Nos. 5,462,467 and 5,564,959 can also be used for making electron emitters, particularly when they are filamentary in shape. For example, with gate openings 215B present in gate layer 215A, dielectric layer 217 can be anisotropically etched through gate openings 215B, to form largely straight openings through dielectric layer 217 down to emitter layer 213. Emitter metal can be electroplated (electrochemically deposited) into the dielectric openings to form metal filaments up nearly to gate openings 215B. The dielectric openings can be optionally widened using an isotropic etchant, and the filaments can be sharpened to form filamentary electron emitters.

The benefits of surface coating, i.e., reduced work function and improved chemical robustness, do not depend on the method used for making the emitters. Thus, as long as emitters 229 are coated with material with a lower work function according to this invention, variations in method for forming emitters 229 are within the scope of the present invention.

Figure 2E:
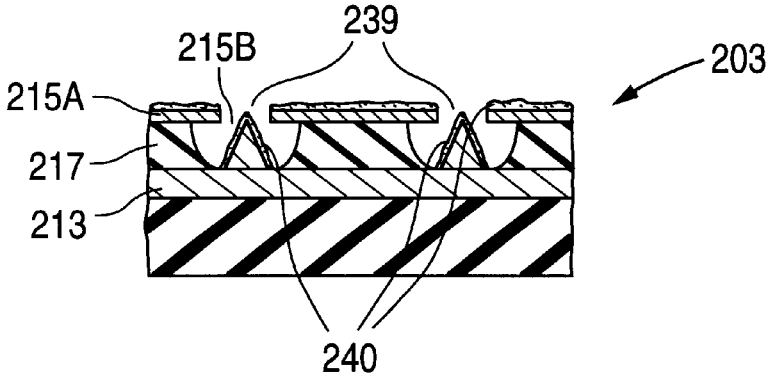

FIG. 2D illustrates the resultant cathode structure 200 with high aspect ratio nickel electron emitters 229. Electrically non-insulating material other than nickel, such as palladium and platinum, may also be used for making emitters 229. Nickel, palladium, and platinum may not have the desired work function and chemical robustness as required for electron emitters. For example, palladium has a work function of about 5.12 eV, while nickel has a work function of about 5.15 eV. Platinum has a work function of about 5.67 eV. Thus, nickel, palladium, and platinum all have work function greater than 5.00 eV. In contrast, molybdenum has a work function of about 4.60 eV. For non-coated emitters made of material with a work function higher than 5.00 eV, such as palladium, platinum, or nickel, a high operating voltage is often required to cause electron emission. Operating voltage is defined as the voltage between gate layer 215A and emitter layer 213 for causing an electron emission of 0.2 nA per emitter 239 (FIG. 2E).

Another problem with some emitter material is the poor chemical robustness. Material with poor chemical robustness tend to chemically react with elements the emitters come into contact with, such as oxygen and water. When such material is used for making emitters, a high vacuum must be maintained within the flat panel display, resulting in higher cost.

Figure 2F:
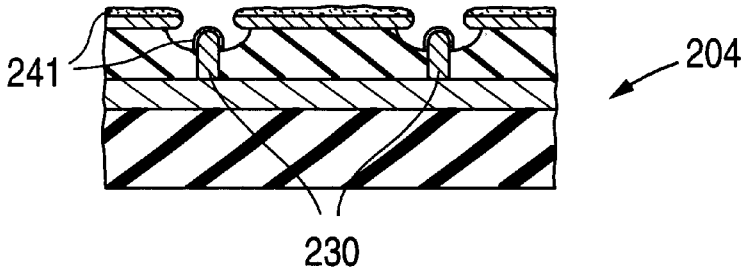

In accordance with the present invention, superior emitter performance is obtained by coating emitters 229 with carbon containing material. The carbon content of the coating material is normally at least 33⅓ atomic percent, typically at least 50 atomic percent, preferably at least 80 atomic percent. FIG. 2E shows a cathode structure 203 in which electron emitters 239 and gate layer 215A have a layer of carbon containing material 240 thereon. FIG. 2F shows a cathode structure 204 with filamentary shaped emitters 230 coated with carbon containing material 241.

Metal emitter materials, such as tantalum, titanium, rhodium, chromium, and vanadium, can similarly benefit from coating with carbon containing material.

Coatings of 5 to 100 angstroms in thickness have been provided on nickel emitters. The thickness of the carbon containing material varies depending on the conditions of the coating process. In one embodiment of the present invention, a coating of 20 to 70 angstroms was found to give good results, even though all coating thicknesses in the 5-to-100 angstrom range were found to be satisfactory.

Comparisons were made on the electron emissive properties of coated nickel emitters and non-coated nickel emitters. The first comparison involved the operating voltage of the emitters. With non-coated nickel emitters, the operating voltage was about 30 to 35 V. The operating voltage for coated nickel emitters was about 20 V. Thus, with carbon containing layer, the operating voltage decreased by 10 to 15 V.

The work functions of coated and non-coated nickel are measured by the contact potential difference method. For nickel not coated with carbon containing layer, the work function is 5.15 eV. The work function of coated nickel emitters is between 4.15 to 4.35 eV. Thus, for nickel emitters, the reduction in work function as a result of coating with a carbon containing layer is determined to be 0.8 to 1.0 eV.

The electron emission uniformity of coated emitters 239 has been measured. In comparison with non-coated nickel emitters 229, coated nickel emitters 239 gave as good, or better, electron emission uniformity.

When depositing carbon onto metal, carbon may form either a crystalline structure or a non-crystalline structure, depending on the condition of the coating process. Carbon in crystalline form is either diamond or graphite, while non-crystalline carbon is amorphous carbon. Amorphous carbon may contain a substantial amount of hydrogen. Amorphous carbon with a substantial amount of hydrogen and a large $sp^3/sp^2$ ratio is also called diamond-like carbon. Amorphous carbon is frequently characterized by the $sp^3/sp^2$ bond ratio. Carbon with a large $sp^3/sp^2$ ratio and little hydrogen is called tetrahedral amorphous carbon. Graphite and amorphous carbon coatings were found to give better uniformity of electron emission than diamond-like-carbon coating, which in turn gives better uniformity than diamond coating.

In accordance with the present invention, some hydrogen is usually present in the carbon containing material that coats emitters 229. The minimum atomic percentage of hydrogen in the carbon containing coating is typically one percent. More particularly, the hydrogen content of the carbon containing material is normally 5–50 atomic percent, usually 10–40 atomic percent, and preferably 15–30 atomic percent.

Figure 3:
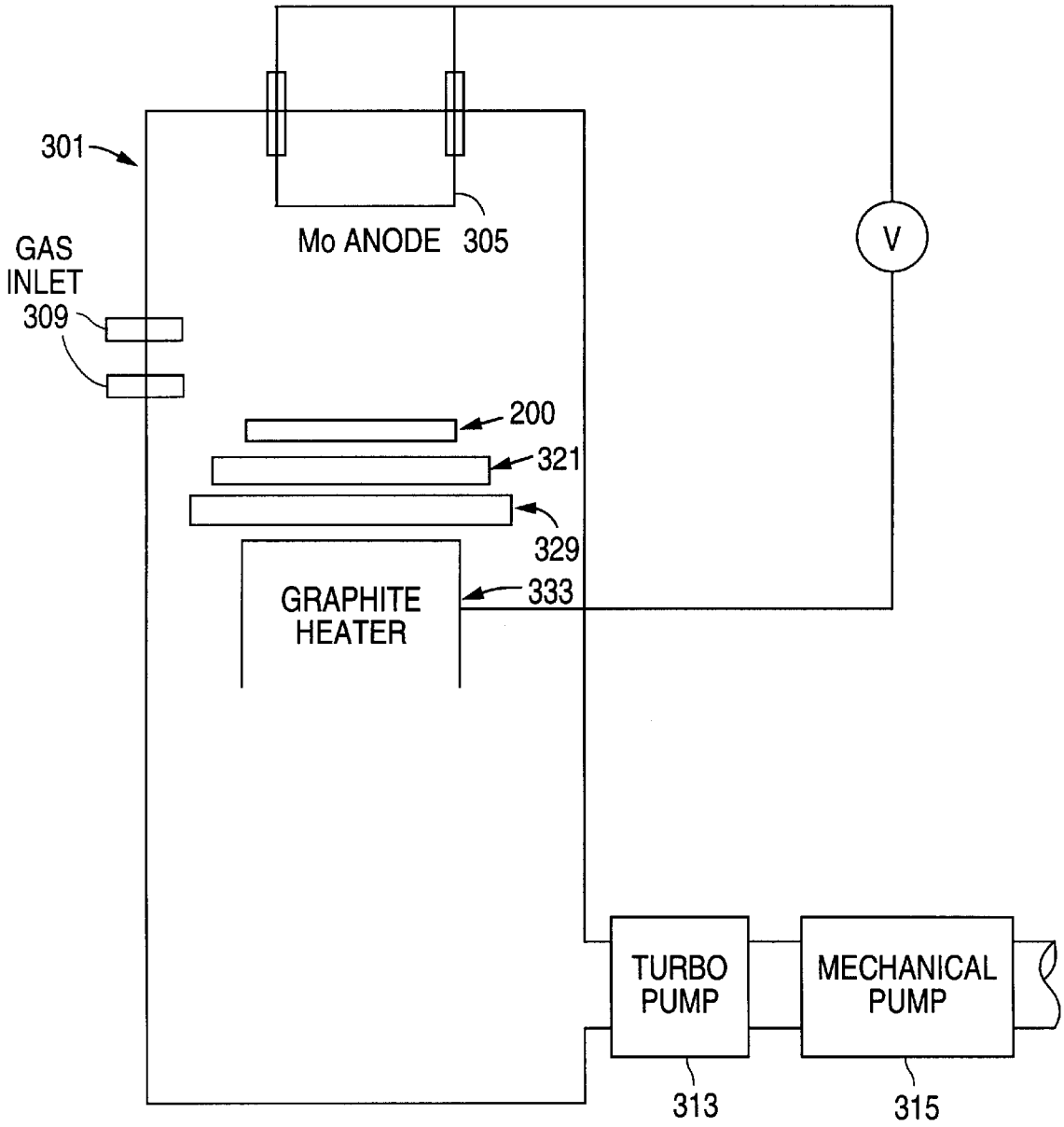
FIG. 3 is a schematic view of a DC plasma reactor used for coating a cathode structure in accordance with the present invention.

FIG. 3 is a schematic view of a DC plasma reactor used for coating nickel emitters with carbon containing material according to the present invention. The carbon containing material consists primarily of carbon mixed with hydrogen.

Reactor chamber 301 of the DC plasma reactor is a 20-cm conflat flange with a 15-cm inner chamber diameter. Chamber 301 is a cool-wall vacuum chamber pumped by a 60 liter-per-second turbo pump 313. Turbo pump 313 is backed by a mechanical pump 315. Plasma gas is provided to reactor chamber 301 through gas inlets 309. Anode 305 is a piece of molybdenum foil. Structure 200 is placed on an electrically insulating macor piece 321. The electrically insulating macor piece sits on a molybdenum plate 329 which in turn sits on an inductive graphite heater 333. Both molybdenum plate 329 and graphite heater 333 serve as cathode for the DC plasma.

Figure 4:
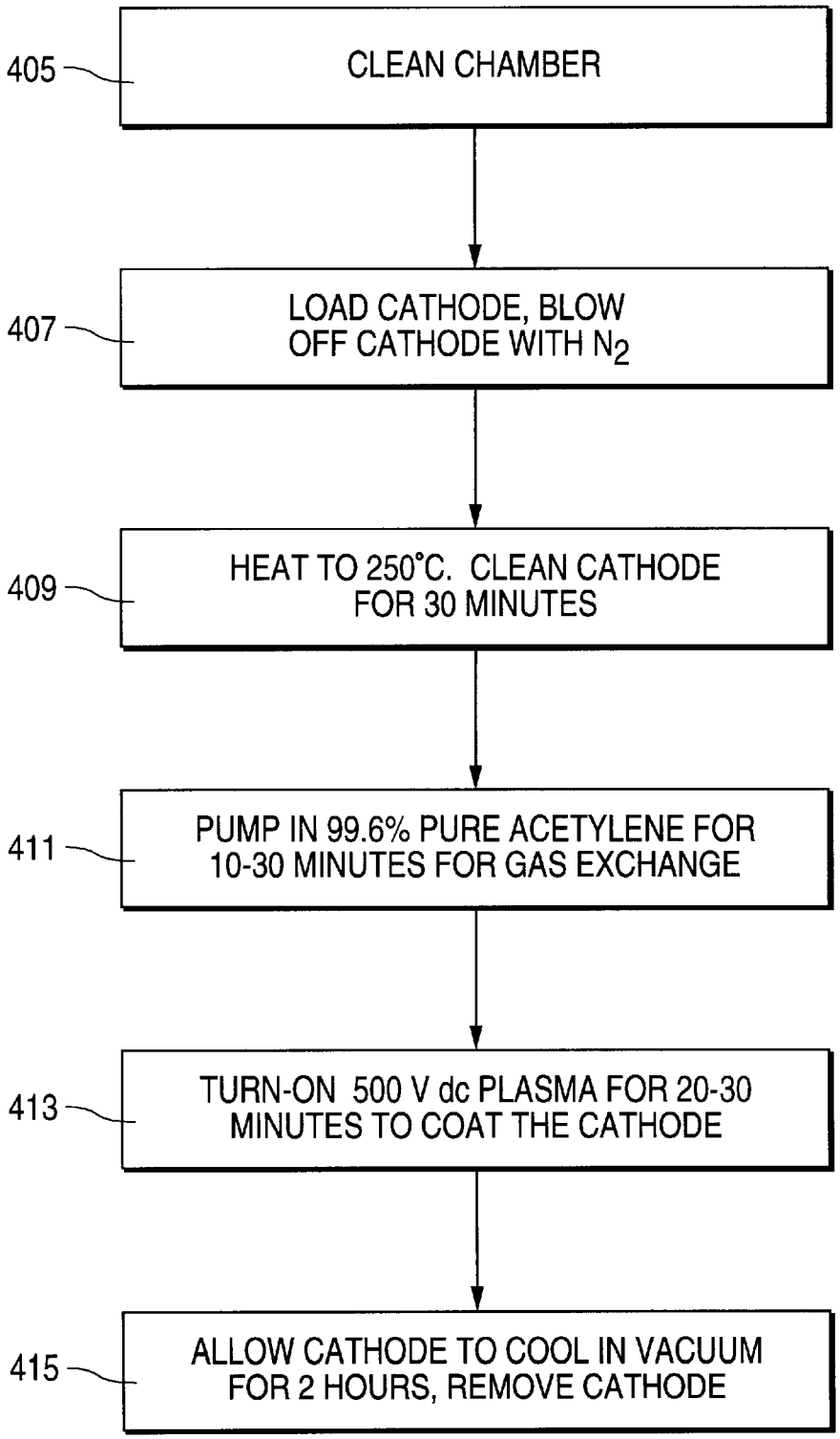
FIG. 4 is a process diagram used for coating a cathode structure in accordance with the present invention.

FIG. 4 is a process diagram for coating emitters 229 with carbon containing material according to the invention using the DC plasma reactor shown in FIG. 3. In step 405, reactor chamber 301, anode 305 and cathode 329 are cleaned with hydrogen plasma. During the cleaning stage, cathode structure 200 is not installed in chamber 301. Reactor chamber 301 is sealed with a copper gasket and evacuated to $1\times10^{-3}$ torr using turbo pump 313. Purified hydrogen (99.9%) is pumped through chamber 301 using mechanical pump 315. A 500 V DC voltage is supplied to anode 305 and graphite heater 333 to generate a DC hydrogen plasma for cleaning. The plasma is run for 15 to 30 minutes. The hydrogen plasma removes carbon deposits on anode 305 and cathode 329 from previous carbon coating runs. Chamber 301 is pumped to 0.3 to 1 torr vacuum. The hydrogen is then pumped out of chamber 301.

In step 407, chamber 301 is opened, and structure 200 is loaded immediately into chamber 301. Dry nitrogen is quickly released into chamber 301 to remove extrinsic particles that have accumulated on structure 200. Chamber 301 is then sealed and pumped to below $5\times10^{-4}$ torr vacuum using turbo pump 313.

In step 409, structure 200 is cleaned with hydrogen plasma while situated within reactor chamber 301. Hydrogen is pumped into chamber 301 and the inductive heater 333 is turned on and set to 200° C.×250° C., the desired carbon deposition temperature. Hydrogen gas is then pumped into chamber 301 to clean cathode structure 200. The conditions for the plasma are 100-sccm flow rate, 300 mtorr, and 500 V DC. Mechanical pump 315 only is used. Hydrogen plasma is run for 30 minutes during which structure 200 is heated to the deposition temperature of 250° C.. In other embodiments, the deposition temperature may vary from 100° C. to 500° C..

During step 411, the DC voltage is turned off, 99.6% pure acetylene at 15 scam is pumped through chamber 301 for 10 to 30 minutes for gas exchange and temperature stabilization.

During step 413, the 500 V DC power is applied to anode 305 and graphite heater 333 to generate DC plasma. Although a 500 V DC voltage is used here, in other embodiments a DC voltage of between 300 V and 500 V can be used. The plasma current is monitored, and structure 200 is coated for 20 to 30 minutes. Carbon containing material is deposited on the exposed surface of structure 200, including the exposed area of emitter layer 213 and the surface of emitters 229, dielectric layer 217, and gate layer 215. Chamber 301 is kept at a vacuum level of 0.1 torr. Mechanical pump 315 only is used.

The plasma gas is then removed from chamber 301. During step 415, structure 200 is allowed to cool to room temperature in the vacuum within chamber 301 for 2 hours. In another embodiment, structure 200 is allowed to cool within chamber 301 for 1 hour.

The crystalline structure and thickness of the carbon coating depend on the voltage, pressure and content of the plasma, and the coating time. For example, the longer the time that the DC acetylene plasma is present and the acetylene gas is flowed through chamber 301 in step 413, the thicker the resulting carbon containing layer.

With the process described above, the resulting carbon containing layer is primarily amorphous carbon mixed with some hydrogen. We believe the $sp^3/sp^2$ bond ratio is greater than one. The carbon content of the carbon containing material is more than 33⅓ atomic percent. With the variation in the carbon deposition conditions, the carbon content may also change. The carbon content can regularly be greater than 50 atomic percent, and under closely controlled deposition conditions, the carbon content can be 80 atomic percent or more. The hydrogen content is normally 1–20 atomic percent.

As explained above, electrically non-insulating carbon containing material is deposited on the exposed surface of structure 200, including the surface of gate layer 215 and the exposed area of emitter layer 213. In one embodiment of this invention, the gate layer is divided into mutually insulated columns for pixel addressing. As used herein, "mutually insulated" means to be spaced apart by vacuum, air or electrically insulating material, or otherwise not in direct contact with each other. Alternatively, a separate electrically non-insulating addressing layer is used for addressing purposes. The addressing layer can either be formed over the gate layer, or between the gate layer and dielectric layer 217. When a separate addressing layer is used, it is divided into mutually insulated columns together with the gate layer thus to accomplish pixel addressing.

Even though a layer of carbon containing material covers the entire upper surface of gate layer 215, there is little danger of electrically shorting the neighboring columns. The carbon containing layer has low conductivity, and the thickness of the carbon layer is small. Thus the resulting conductance through the carbon containing layer from column to column is negligible.

Figure 5:
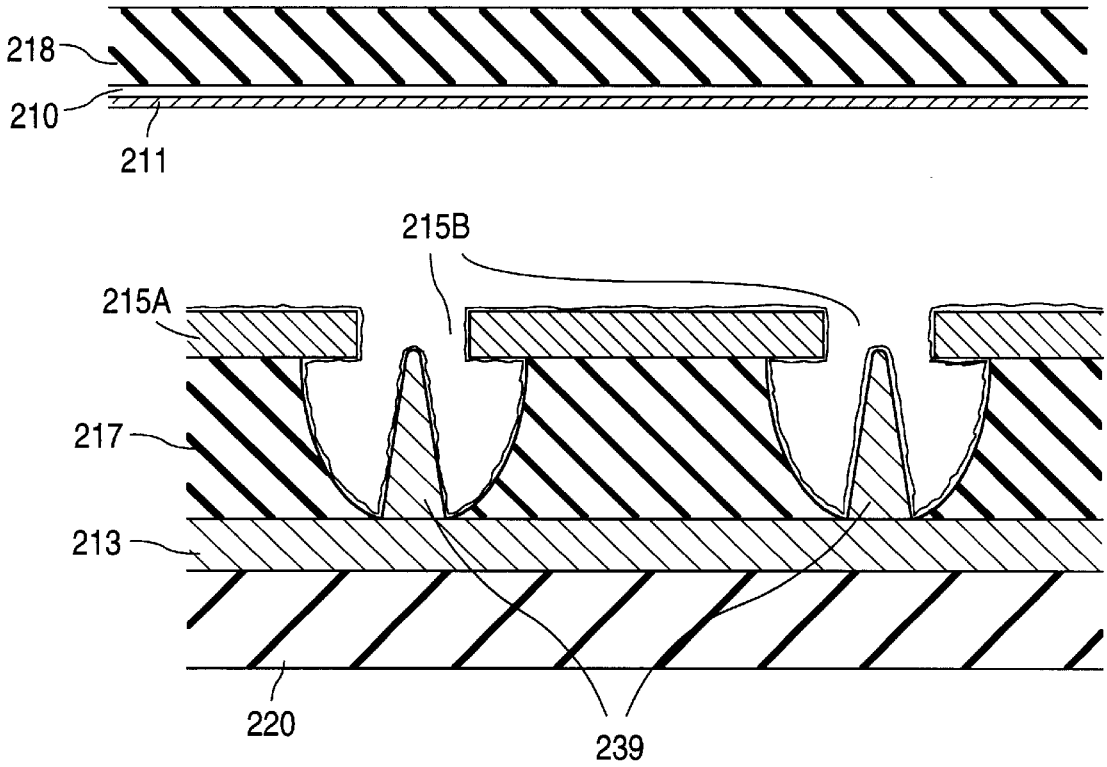
FIG. 5 is a cross-sectional view of a flat panel display in accordance with the present invention using the electron emitters of FIG. 2E.

FIG. 5 shows a flat panel display 500 in accordance with the present invention using coated nickel electron emitters 239. Display panel 218 with light emissive layer 210 and anode layer 211 is situated above, and spaced vertically from, gate layer 215A. Light emissive layer 210 is typically a layer of phosphor situated over display panel 218. Note that a carbon containing layer is deposited over emitters 239, gate layer 215A and dielectric layer 217. For addressing purposes, gate layer 215A is divided into columns while emitter layer 213 is divided into rows. Alternatively, gate layer 215A can be divided into rows while emitter layer 213 can be divided into columns. An insulated column or row of the gate layer is called a gate line, while an insulated row or columns of the emitter layer is called an emitter line.

Flat panel display 500 has improved electron emission uniformity with reduced operating voltage in comparison to conventional flat panel displays.

Figure 6A:
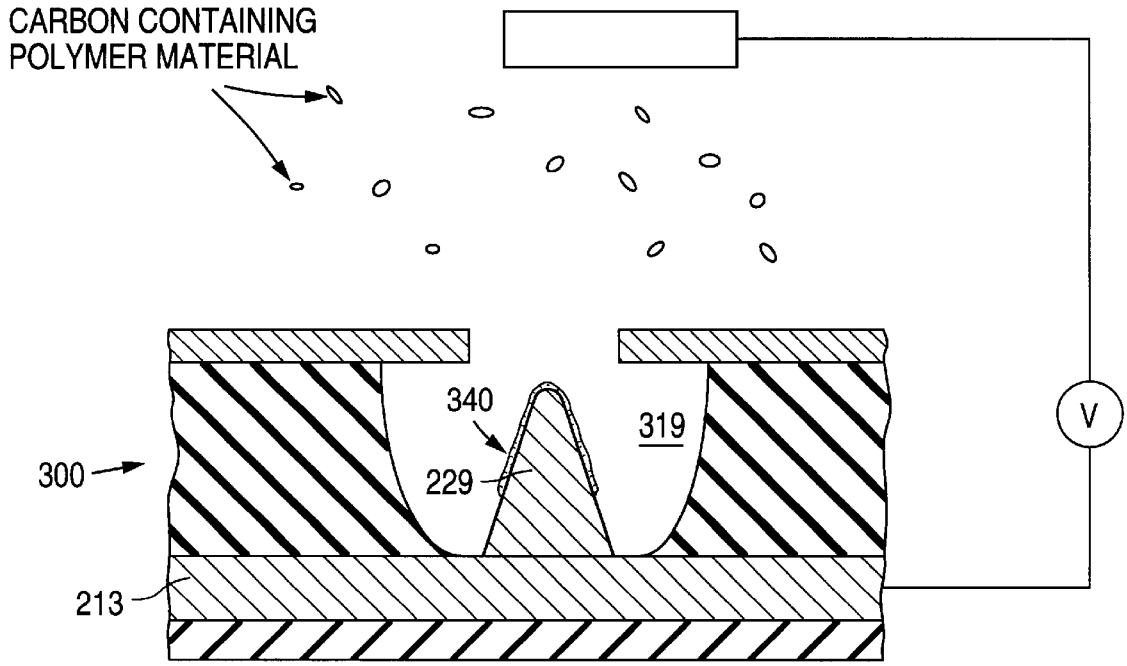
FIG. 6A is a schematic view of an apparatus for coating a cathode structure using electrochemical deposition.

FIG. 6A illustrates another method for electrochemically coating electron emitters 229 with carbon containing material. A cathode structure is submerged in a suitable electrolytic solution containing raw carbon-based material in the form of a polymer or monomer. The carbon content in the raw carbon-based monomer and straight-chain polymers is normally no more than 50 atomic percent, commonly less than 33⅓ atomic percent. The raw carbon-based material is subsequently processed to increase the carbon content to make the carbon containing material.

An electric field is created in the electrolytic solution. The polymer or monomer material is deposited on emitters 229, one of which is shown in FIG. 6A, through electrolytic deposition. Normally it is easier for the polymer or monomer to reach and deposit on the emitter tip rather than on the lower surface material of emitters 229. As a result, the thickness of the deposit at the tips is normally greater than that in other areas, especially near the bases of emitters 229.

Figure 6B:
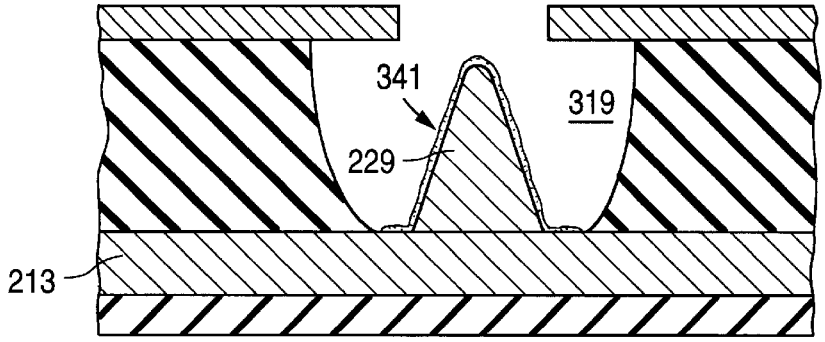
FIGS. 6B–6E are cross-sectional views of cathode structures where the emitters are coated with carbon containing material using electrochemical deposition.
Figure 6C:
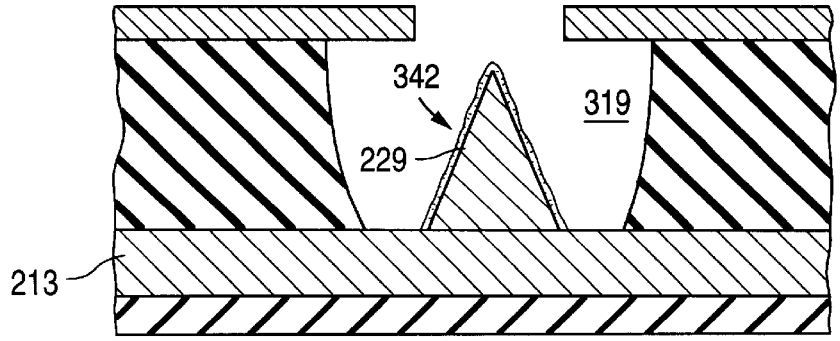

The polymer or monomer can nonetheless be deposited on the lower material of emitters 229, including the material along the peripheries of the emitter bases, and on the exposed area of emitter layer 213. Several factors determine whether or not the polymer or monomer deposits on the lower material of emitters 229 and the exposed area of emitter layer 213. Those factors include the size of hollow spaces 319, the deposition temperature, the surface tension of the electrolytic solution relative to emitters 229 and emitter layer 213, and the amount and strength of surface active wetting agent used, if any. FIG. 6B shows a cathode structure where polymer or monomer is coated on the entire exposed surface of each emitter 229 as well as the exposed area of emitter layer 213. FIG. 6C shows a cathode structure where the entire exposed surface of each emitter 229 is coated with polymer or monomer while the exposed area of the emitter layer 213 is not coated with the polymer or monomer.

The polymer or monomer layer is then suitably treated to produce the desired carbon containing material coating. One process of treatment is pyrolysis. An alternative treating process is a chemical treatment process by which the polymer or monomer layer is modified into a layer of the desired carbon containing material. A suitable chemical treatment process is disclosed in U.S. Pat. No. 5,463,271, the content of which is incorporated by reference herein. The carbon content of the final coating is normally greater than 33⅓ atomic percent, often greater than 50 atomic percent but, in any event, greater than in the raw carbon-based material.

Figure 6D:
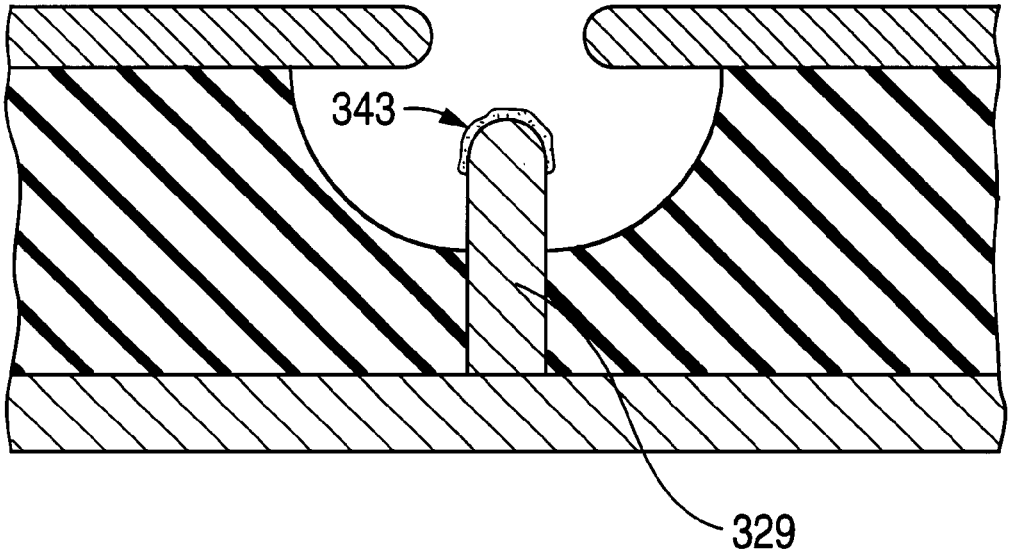
Figure 6E:
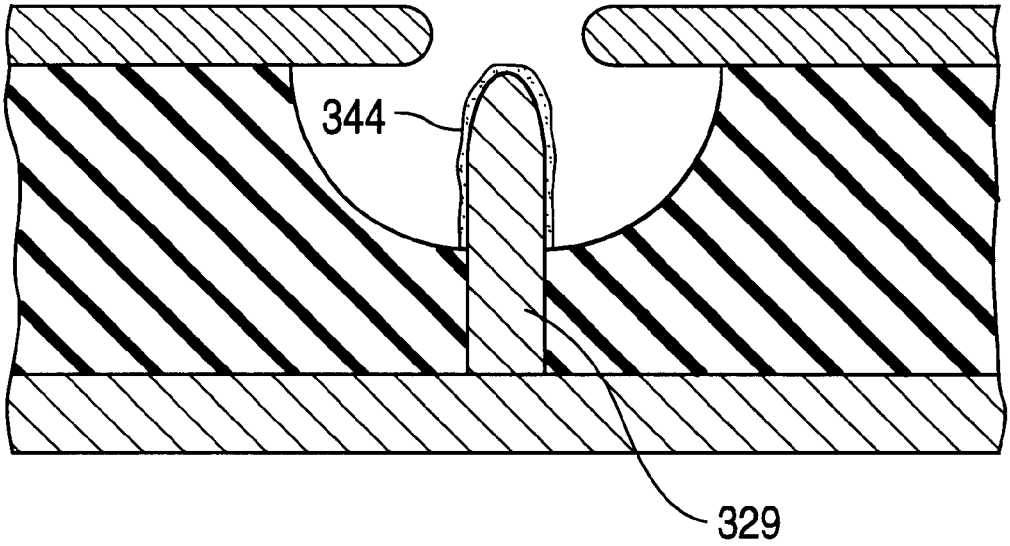

FIGS. 6D and 6E show filamentary shaped emitters coated with carbon containing material using the electrochemical deposition process described above. In FIG. 6D the carbon containing material is coated only on the tip area of emitters 329, while in FIG. 6E the carbon containing material is coated on the entire exposed area of each emitter 329.

The above described coating processes are for illustrative purposes only. For similar coating results, variations can be made to the processes described above. For example, in the plasma coating process, voltages and/or times different from those described above may be employed. Other forms of energy, such as microwaves or radio frequency waves, may also be used to produce the plasma. These variations do not deviate from the general principles of the invention and are considered within the scope of the invention.

Although this invention has been described in connection with several embodiments and examples, the invention is not limited to the embodiments disclosed, but is capable of various modifications. The invention is only limited by the following claims.

What is claimed is:

1. A structure comprising:

a sub-structure comprising an electrically non-insulating emitter layer divided into mutually insulated emitter lines;

a pluality of electron etters situated over said emitter lines, each emitter comprising electrically non-insulating material;

an electrically non-insulating gate layer having an upper surface spaced largely above said electron emitters, said gate layer having a plurality of gate holes each corresponding to one of said electron emitters, said gate layer being divided into mutually insulated gate lines; and a carbon-containing layer coated over each of said electron emitters and directly on at least part of said gate layer, said carbon-containing layer comprising tetrahedral amorphous carbon, at least part of said carbon-containing layer along and above said gate layer being exposed to open space external to said structure.

2. A structure according to claim 1, wherein said carbon-containing layer is 5 to 100 angstroms in thickness.

3. A structure according to claim 1, wherein said carbon-containing layer consists of at least 50 atomic percent carbon.

4. A structure according to claim 1, wherein said emitters are generally conical or filamentary in shape.

5. A structure according to claim 1, wherein said emitters comprise nickel.

6. A structure according to claim 1, wherein said carbon-containing layer consists of at least 33⅓ atomic percent carbon.

7. A structure according to claim 1, wherein said carbon-containing layer consists of at least 80 atomic percent carbon.

8. A structure according to claim 1, wherein said carbon-containing layer consists of 1 to 20 atomic percent hydrogen.

9. A structure according to claim 1, wherein said emitters comprise at least one of nickel, palladium, platinum, rhodium, and vanadium.

10. A structure according to claim 1, wherein said emitters are generally conical in shape and comprise nickel.

11. A flat panel display comprising:

a display panel having an anode layer and a light emissive layer;

a backplate disposed in spaced alignment from said display panel;

an electrically non-insulating emitter layer situated over said backplate, said emitter layer divided into spaced apart emitter lines;

a plurality of electron emitters situated over said emitter lines, each emitter comprising electrically non-insulating material;

an electically non-inslatig gate layer having an upper surface spaced largely above said electron emitters, said gate layer having a plurality of gate holes each corresponding to one of said electron emitters, said gate layer being divided into mutually insulated gate lines; and a carbon-containing layer coated over each of said electron emitters and directly on at least part of said upper surface of said gate layer, said carbon-contaiting layer comprising tetrahedral amorphous carbon, at least part of said carbon-containing layer along and above said gate layer being exposed to a substantial vacuum inside said display.

12. A flat panel display according to claim 11, wherein said emitters are generally conical or filamentary in shape.

13. A flat panel display according to claim 11, wherein said carbon-containing layer consists of at least 50 atomic percent carbon.

14. A flat panel display according to claim 11, wherein said carbon-containing layer consists of 1 to 20 atomic percent hydrogen.

15. A flat panel display according to claim 11, wherein said carbon-containing layer is 5 to 100 angstroms in thickness.

16. A flat panel display according to claim 11, further including a dielectric layer overlying said emitter layer, underlying said gate layers and having a plurality of dielectric openings, each emitter situated largely in a corresponding one of said dielectric openings and exposed through the corresponding one of said gate holes.

17. A flat panel display according to claim 11, wherein said emitters comprise nickel.

18. A flat panel display according to claim 11, wherein said carbon-containing layer consists of at least 33⅓ atomic percent carbon.

19. A flat panel display according to claim 11, wherein said carbon-containing layer consists of at least 80 atomic percent carbon.

20. A flat panel display according to claim 11, wherein said emitters comprise at least one of nickel, palladium, platinum, rhodium, and vanadium.

21. A flat panel display according to claim 11, wherein said emitters are generally conical in shape and comprise nickel.

22. A structure comprising:

a sub-structure comprising an electrically non-insulating emitter layer divided into mutually insulated emitter lines;

a plurality of electron emitters situated over said emitter lines, each emitter comprising electrically non-insulating material;

an electrically non-insulating gate layer having an upper surface spaced largely above said electron emitters, said gate layer having a plurality of gate holes each corresponding to one of said electron emitters, said gate layer being divided into mutually insulated gate lines; and a carbon-containing layer coated over each of said electron emitters and directly on at least part of said gate layer, said carbon-containing layer comprising graphite, at least said part of said carbon-containing layer along and above said gate layer being exposed to open space external to said structure.

23. A structure according to claim 22, wherein said carbon-containing layer is at least 33⅓ atomic percent carbon.

24. A structure according to claim 22, wherein said carbon-containing layer is at least 50 atomic percent carbon.

25. A structure according to claim 22, wherein said carbon-containing layer is at least 80 atomic percent carbon.

26. A structure according to claim 22, wherein said emitters comprise at least one of nickel, palladium, platinum, rhodium, and vanadium.

27. A structure according to claim 22, wherein said emitters are generally conical in shape.

28. A structure according to claim 27, wherein said emitters comprise nickel.

29. A structure according to claim 22, wherein said emitters are generally filamentary in shape.

30. A flat panel display comprising:

a display panel having an anode layer and a light emssive layer;

a backplate disposed in spaced alignment from said display panel;

an electrically non-insulating emitter layer situated over said backplate, said emitter layer divided into spaced apart emitter lines;

a plurality of electron emitters situated over said emitter lines, each emitter comprising electrically non-insulating material;

an electrically non-insulating gate layer having an upper surface spaced largely above said electron emitters, said gate layer having a plurality of gate holes each corresponding to one of said electron ernitters, said gate layer being divided into mutually insulated gate lines; and a carbon-containing layer coated over each of said electron emitters and directly on at least part of said upper surface of said gate layer, said carbon-containing layer comprising graphite, at least part of said carbon-containing layer along and above said gate layer being exposed to a substantial vacuum inside said display.

31. A flat panel display according to claim 30, wherein said carbon-containing layer is at least 33⅓ atomic percent carbon.

32. A flat panel display according to claim 30, wherein said carbon-containing layer is at least 50 atomic percent carbon.

33. A flat panel display according to claim 30, wherein said carbon-containing layer is at least 80 atomic percent carbon.

34. A flat panel display according to claim 30, wherein said emitters comprise at least one of nickel, palladium, platinum, rhodium, and vanadium.

35. A flat panel display according to claim 30, wherein said emitters are generally conical in shape.

36. A flat panel display according to claim 35, wherein said emitters comprise nickel.

37. A flat panel display according to claim 30, wherein said emitters are generally filamentary in shape.

38. A flat panel display according to claim 30, further including a dielectric layer overlying said emitter layer, underlying said gate layer, and having a plurality of dielectric openings, each emitter situated largely in a corresponding one of said dielectric openings and exposed through the corresponding one of said gate holes.

39. A structure comprising:

a sub-structure comprising an electrically non-isulating emitter layer divided into mutually insulated emitter lines, a plurality of electron emitters situated over said emitter lines, each emitter comprising nickel and being generally conical in shape;

an electrically non-insulating gate layer having an upper surface spaced largely above said electron emitters, said gate layer having a plurality of gate holes each corresponding to one of said electron emitters, said gate layer being divided into mutually insulated gate lines; and a carbon-containing layer coated over each of said electron emitters and directly on at least part of said gate layer, at least part of said carbon-containing layer along and above said gate layer being exposed to open space external to said structure.

40. A structure according to claim 39, wherein said carbon-containing layer is at least 33⅓ atomic percent carbon.

41. A structure according to claim 39, wherein said carbon-containing layer is at least 50 atomic percent carbon.

42. A structure according to claim 39, wherein said carbon-containing layer is at least 80 atomic percent carbon.

43. A structure according to claim 39, wherein said carbon-containing layer comprises at least one of graphite and tetrahedral amorphous carbon.

44. A structure according to claim 39, wherein said carbon-containing layer comprises diamond-like carbon.

45. A flat panel display comprising:

a display panel having an anode layer and a light emissive layer;

a backplate disposed in spaced alignment from said display panel;

an electrically non-insulating emitter layer situated over said backplate, said emitter layer divided into spaced apart emitter lines;

a plurality of election emitters situated over said emitter lines, each emitter comprising nickel and being generally conical in shape;

an electrically non-insulating gate layer having an upper surface spaced largely above said electron emitters, said gate layer having a plurality of gate holes each correspondit to one of said electron emitters, said gate layer being divided into mutually insulated gate lines; and a carbon-containing layer coated over each of said electron emitters and directly on at least part of said upper surface of said gate layer, at least part of said carbon-containing layer along and above sad gate layer being exposed to a substanial vacuum inside said display.

46. A flat panel display according to claim 45, wherein said carbon-containing layer is at least 33⅓ atomic percent carbon.

47. A flat panel display according to claim 45, wherein said carbon-containing layer is at least 50 atomic percent carbon.

48. A flat panel display according to claim 45, wherein said carbon-containing layer is at least 80 atomic percent carbon.

49. A flat panel display according to claim 45, wherein said carbon-containing layer: comprises at least one of graphite and tetrahedral amorphous carbon.

50. A flat panel display according to claim 45, wherein said carbon-containing layer comprises diamond-like carbon.

51. A flat panel display according to claim 45, further including a dielectric layer overlying said emitter layer, underlying said gate layer, and having a plurality of dielectric openings, each emitter situated largely in a corresponding one of said dielectric openings and exposed through the corresponding one of said gate holes.

52. A structure comprising:

a sub-stucture comprising an electrically non-insulating emitter layer divided into mutually insulated emitter lines;

a plurality of electron emitters situated over said emitter lines, each emitter comprising electrically non-insulating material;

an electrically non-insulating gate layer having an upper surface spaced largely above said electron emitters, said gate layer having a plurality of gate holes each corresponding to one of said electron emitters, said gate layer being divided into mutually insulated gate lines; and a carbon-containing layer coated over each of said electron emitters and directly on at least part of said gate layer, at least part of said carbon-containing layer along and above said gate layer being exposed to open space external to said structure.

53. A structure according to claim 52, wherein said carbon-containing layer is at least 33⅓ atomic percent carbon.

54. A structure according to claim 52, wherein said carbon-containing layer is at least 50 atomic percent carbon.

55. A structure according to claim 52, wherein said carbon-containing layer is at least 80 atomic percent carbon.

56. A structure according to claim 52, wherein said emitters comprise at least one of nickel, palladium, platinum, rhodium, and vanadium.

57. A structure according to claim 52, wherein said emitters are generally conical in shape.

58. A structure according to claim 57, wherein said emitters comprise nickel.

59. A structure according to claim 52, wherein said emitters are generally filamentary in shape.

60. A flat panel display comprising:

a display panel having an anode layer and a light emissive layer, a backplate disposed in spaced alignment from said display panel;

an electrically non-insulating emitter layer situated over said backplate, said emitter layer divided into spaced apart emitter lines;

a plurality of electron emitters situated over said emitter lines, each emitter comprising electrically non-insulating material;

an electrically non-insulating gate layer having an upper surface spaced largely above said electron emitters, said gate layer having a plurality of gate holes each corresponding to one of said electron emitters, said gate layer being divided into mutually insulated gate lines; and a carbon-containing layer coated over each of said electron emitters and directly on at least part of said upper surface of said gate layer, at least part of said carbon-containing layer along and above said gate layer being exposed to a substantial vacuum inside said display.

61. A flat panel display according to claim 60, wherein said carbon-containing layer is at least 33⅓ atomic percent carbon.

62. A flat panel display according to claim 60, wherein said carbon-containing layer is at least 50 atomic percent carbon.

63. A flat panel display according to claim 60, wherein said carbon-containing layer is at least 80 atomic percent carbon.

64. A flat panel display according to claim 60, wherein said emitters comprise at least one of nickel, palladium, platinum, rhodium, and vanadium.

65. A flat panel display according to claim 60, wherein said emitters are generally conical in shape.

66. A flat panel display according to claim 65, wherein said emitters comprise nickel.

67. A flat panel display according to claim 60, wherein said emitters are generally filamentary in shape.

68. A flat panel display according to claim 60, further including a dielectric layer overlying said emitter layer, underlying said gate layer, and having a plurality of dielectric openings, each emitter situated largely in a corresponding one of said dielectric openings and exposed through the corresponding one of said gate holes.

* * * * *